US006165627A

United States Patent [19]

Miyazaki et al.

[11] Patent Number: 6,165,627

[45] Date of Patent: Dec. 26, 2000

[54] IRON ALLOY WIRE AND MANUFACTURING METHOD

[75] Inventors: Kenji Miyazaki; Shinichi Kitamura; Atsushi Yoshida, all of Osaka; Shinichiro Yahagi; Takanobu Saito, both of Aichi, all of Japan

[73] Assignees: Sumitomo Electric Industries, Ltd., Osaka; Daido Steel Co., Ltd., Nagoya, both of Japan

[21] Appl. No.: 09/033,334

[22] Filed: Mar. 2, 1998

Related U.S. Application Data

[63] Continuation-in-part of application No. 08/580,306, Dec. 28, 1995, abandoned.

[30] Foreign Application Priority Data

Jan. 23, 1995 [JP] Japan ..... 7-8236

[51] Int. Cl.[7] ..... C22C 38/08

[52] U.S. Cl. ..... 428/606; 428/364; 428/553; 428/680; 148/320; 148/336; 148/409; 148/595

[58] Field of Search ..... 148/320, 336, 148/409, 595; 428/680, 606, 364, 553; 419/4

[56] References Cited

U.S. PATENT DOCUMENTS

| | | |
|---|---|---|
| 4,295,900 | 10/1981 | Malmgren et al. . |
| 4,297,135 | 10/1981 | Giessen et al. . |
| 4,309,489 | 1/1982 | Momose et al. . |
| 4,360,390 | 11/1982 | Tominaga et al. . |
| 4,533,401 | 8/1985 | Yutori et al. . |
| 4,752,334 | 6/1988 | Nadkarni et al. . |
| 5,080,727 | 1/1992 | Aihara et al. . |
| 5,156,692 | 10/1992 | Tsukamoto . |
| 5,338,380 | 8/1994 | Yutori et al. . |
| 5,605,582 | 2/1997 | Inoue et al. . |
| 5,639,317 | 6/1997 | Yahagi et al. . |

FOREIGN PATENT DOCUMENTS

| | | |
|---|---|---|
| 0723030 | 7/1996 | European Pat. Off. . |
| 54-136563 | 10/1979 | Japan . |
| 55-119156 | 9/1980 | Japan . |
| 57-110659 | 7/1982 | Japan . |
| 4-224630 | 8/1992 | Japan . |
| 5-070894 | 3/1993 | Japan . |
| 332982 | 1/1971 | U.S.S.R. . |

OTHER PUBLICATIONS

Advanced Materials & Process, May 1997, pp. 31–34, "Invar at 100 Years" by L. L. Harner.

Physics and Applications of Invar Alloys, Mazuren Company Ltd., Tokyo, 1978, pp. 521–528.

*Primary Examiner*—Timothy M. Speer
*Assistant Examiner*—Jennifer McNeil
*Attorney, Agent, or Firm*—W. F. Fasse; W. G. Fasse

[57] ABSTRACT

An INVAR® or iron nickel alloy or iron nickel cobalt alloy wire has an area ratio of carbide existing at the grain boundaries of the wire in the finished wire of at most 4%, or an average grain size in the transverse direction within a range of 1 to 5 $\mu$m. Such a wire has a superior twisting property.

10 Claims, No Drawings

IRON ALLOY WIRE AND MANUFACTURING METHOD

This application is a continuation in part of Ser. No. 08/580,306 filed Dec. 28, 1995 now abandoned.

FIELD OF THE INVENTION

The present invention relates to a wire made of an iron alloy, for example, an INVAR® or iron nickel alloy, wherein a proportion of the nickel component may be replaced by cobalt. Such wires have an excellent toughness, strength and a low thermal expansion property. The present wire can be used preferably as strands for overhead conductor cables, "INVAR" is a trademark.

BACKGROUND INFORMATION

An INVAR® or iron nickel alloy having the composition of Fe-36 wt % Ni has been known as an alloy having a low thermal expansion property. Such an alloy is used for precision parts, for example. In order to increase the transmission capacity of an aluminum cable steel reinforced (ACSR) as overhead conductor cable, a method of reducing cable slack of the conductor cable caused by an increase in temperature during power transmission, has been studied. One method has been known in which an alloy wire having a low thermal expansion property is used as a steel core to reduce cable slack. An INVAR® or iron nickel alloy wire such as disclosed in Japanese Patent Laying-Open No. 55-119156 has been developed as an alloy wire having a low thermal expansion property.

The alloy wire developed in accordance with Japanese Patent Laying-Open No. 55-119156 is a hard material and exhibits a tensile strength of 120 kg/mm$^2$. However, it exhibits a low toughness property stability such as turns of twisting after it has been finally subjected to zinc or zinc alloy plating, thereby reducing the production yield of conductor cables. Zinc alloy plating or the like is applied to improve the corrosion resistance of the conductor cable. However, an intermetallic compound formed at the interface with the plating tends to lower the twisting property of the alloy wire.

Therefore, it is an object of the present invention to improve the toughness of a conventionally used INVAR® or iron nickel alloy wire having high strength, and, more particularly, to improve the twisting property or twisting ability of the wire in its finished wire size.

SUMMARY OF THE INVENTION

In a preferred embodiment an iron alloy electrical conductor wire in accordance with the present invention has a given cross-sectional area and a longitudinal axis extending perpendicularly to said cross-sectional area, said finished wire comprising an iron alloy including a nickel content (Ni) within the range of 34 to 40.0 wt. % and carbon within the range of 0.1 to 0.5 wt. % as alloying elements, and impurities including as weight % of the alloy: phosphorous (P) 0.01 wt. % at most, sulfur (S) 0.004 wt. % at most, oxygen (O) 0.005 wt. % at most, and nitrogen (N) 0.008 wt. % at most, said alloy in said finished wire having grains with an average grain size within the range of 1 to 5 $\mu$m as ascertained from a micrograph taken of said given cross-sectional area, said finished wire further comprising precipitates at the boundaries between said grains in said alloy, said precipitates taking up a surface area ratio of 4% at most of said given cross-sectional area, whereby said finished wire has an improved strength and toughness, and a low thermal expansion as determined by said nickel content.

According to a second preferred embodiment of the invention the present iron alloy wire contains cobalt which replaces some of the nickel to the extent of more than 0% by weight of the alloy but not more than 6 wt. %.

In both embodiments the present finished wire has a superior toughness, tensile strength and a low thermal expansion property. The precipitates are primarily carbide. The working and heat treatment steps are referred to as "processing" herein.

A method of manufacturing an INVAR® or iron nickel alloy wire or an iron nickel cobalt alloy wire having an excellent toughness, tensile strength and a low thermal expansion property in accordance with still another aspect of the present invention includes the steps of preparing an INVAR® or iron nickel alloy containing Fe and Ni as main elements, performing hot working and heat treatment in combination to suppress the formation of precipitates so that the area ratio of precipitates to main alloy elements existing at the grain boundaries of the alloy is at most 2%, and thereafter, performing cold working and a heat treatment in combination to again suppress the formation of precipitates so that the area ratio of precipitates to main alloy elements existing at the grain boundary of the alloy in the finished wire state of the wire is at most 4%.

The method of manufacturing an INVAR® or iron nickel alloy or an iron nickel cobalt alloy in accordance with a still further aspect of the present invention includes the steps of preparing an INVAR® or iron nickel alloy containing, as main elements Fe and Ni, performing hot rolling and heat treatment in combination to process the alloy into a rod shape and to simultaneously produce an average grain size in the longitudinal direction of the rod to be within the range of 5 to 40 $\mu$m, and thereafter performing cold working and a further heat treatment in combination to reduce the average grain size in the transverse direction of the finished wire to be within the range of 1 to 5 $\mu$m.

By keeping the above mentioned area ratio of the precipitates existing at the grain boundaries between the grains of the wire in the processed, finished wire at 4% at most, the twisting property or twisting ability of the wire is improved. Especially, when the area ratio of the precipitates existing at the grain boundaries of the wire in the finished wire is at most 2%, the twisting property or ability and the reliability of the wire is remarkably improved.

Keeping the grain size in the transverse direction of the wire in the processed, finished wire within the range of 1 to 5 $\mu$m, also contributes to an improved twisting property or ability of the wire. Especially when the average grain size of the grains in the transverse direction of the finished wire is within 1.5 to 4 $\mu$m, the twisting property or ability and the reliability of the wire are significantly improved.

The present method of manufacturing an INVAR® or iron nickel alloy or iron nickel cobalt permits keeping the area ratio of the precipitates existing at the grain boundaries of the alloy even lower than 4%, namely 2% at most by the combination of hot working and heat treatment to thereby achieve a superior twisting ability. When the formation of the precipitates is further suppressed, an INVAR® or iron nickel alloy wire or an iron nickel cobalt alloy wire having a significantly improved twisting ability is produced. Such further suppression yields an area ratio of the precipitates existing at the grain boundaries of the alloy within the range of 1% to 2% at most, by the combination of hot working and heat treatment followed by a further combination of cold working and heat treatment.

In the method of manufacturing an INVAR® or iron nickel alloy wire or an iron nickel cobalt alloy wire in accordance with the present invention, the alloy is processed to a rod shape by the combination of hot working and heat treatment to first achieve an average grain size in the longitudinal direction of the rod within the range of 5 to 40 μm. The further combination of cold working and heat treatment, produces an average grain size in the transverse direction of the finished wire within the range of 1 to 5 μm. These area ratios and average grain size provide a wire having a superior twisting ability. The "transverse" and "longitudinal" direction here have reference to a micrograph taken crosswise to the longitudinal wire axis and in the longitudinal wire axis, respectively.

DESCRIPTION OF THE PREFERRED EMBODIMENTS

A conventionally used INVAR® or iron nickel alloy wire having a high tensile strength contains, as main elements, Fe and Ni, whereby Co may be partially substituted for Ni to the extent of more than 0 wt. %, but not more than 6 wt. % of the alloy. Generally, such an INVAR® or iron nickel alloy or iron nickel cobalt alloy wire having a high strength contains at least one of Mo, Cr, C, W, Nb, Ti, V, Si or the like as a strengthening element, and in addition, at least one of Mn, Al, Mg, Ti, Ca or the like as a deoxidizer. It has been found that the molybdenum content should be within the range of 1.0 wt. % to 4.0 wt. %. The chromium content should not be more than 1.1 wt. %, preferably less than 1.1. wt. %. The carbon content should be within the range of 0.1 wt. % to 0.5 wt. %. The weight proportions of the remaining components will be selected with due regard to conventional strength requirements to be satisfied by the wire and by conventional deoxidizing needs.

The inventors performed various investigations to eliminate destabilizing factors related to the toughness of such INVAR® or iron nickel alloy wire having a high tensile strength. As a result, it was found that the crystal grain size of the grains in the wire, the amount of precipitates at the grain boundaries in the wire and the amount of specific impurity elements have significant effects on the toughness of the wire. It was also found that there is a preferable method of processing and heat treating for controlling the grain size and the amount of precipitates at the grain boundaries inside the finished wire. The precipitates at the grain boundaries here are primarily carbide.

In order to suppress the formation of precipitates at the grain boundaries in the finished wire, any of the following methods may be used: a method in which the cooling is started as a kind of heat treatment from a solid solution temperature during hot rolling; a method in which a solution heat treatment is performed prior to hot rolling; and a method in which the solution heat treatment is performed after hot rolling. No matter which of the methods is employed, the smaller the amount of precipitates at the grain boundaries after the combined hot working and heat treatment, the smaller the amount of precipitates at the grain boundaries precipitated during the subsequent cold working and heat treatment. Therefore, the formation of precipitates should be suppressed as much as possible in each of the applied combination of steps, so that the amount of precipitates existing at the grain boundaries in the finished wire is as small as possible.

TABLE 1

(Example)

| Element | C | Mn | Ni | Co | Cr | Mo | P | S | O | N | Fe |
|---|---|---|---|---|---|---|---|---|---|---|---|
| Wt. % | 0.25 | 0.30 | 35.0 | 3.01 | 0.98 | 2.01 | 0.002 | 0.001 | 0.0015 | 0.0013 | Remaining part |

As an example, an INVAR® or iron nickel alloy having such a composition as shown in Table 1 was melted and cast.

TABLE 2

| Sample | Rolling Start Temperature (° C.) | Cooling Rate (° C./sec) | Area Ratio of Precipitates at Grain Boundaries (%) | Average Grain Size in Longitudinal Direction (μm) |
|---|---|---|---|---|
| A | 1200 | 10 | 0.2 | 22 |
| B | 1150 | 8 | 0.6 | 14 |
| C | 1100 | 7 | 0.9 | 5 |
| D | 1250 | 3 | 3.8 | 75 |
| E | 1200 | 5 | 2.8 | 59 |

Table 2 shows the dependency of the average grain size and of the area ratio of precipitates from the temperature at which rolling is started and from the rate of cooling during rolling until the temperature reaches 600° C. At this temperature the INVAR® or iron nickel alloy shown in Table 1 is subjected to hot rolling. The average grain size here is taken in the longitudinal direction of the wire after rolling. The area ratio of the precipitates is taken at the grain boundary. For measuring the area ratio of the precipitates at the grain boundary, the rolled rod was cut along its longitudinal direction, the cut surface was polished and etched for 40 seconds by using a 5% nital solution, and the surface was then photographed with a magnification of 4000 by using a scanning type electron microscope. The microphotograph was processed by an automatic image processing apparatus and the area ratio of the precipitates existing at the grain boundary was calculated. Further, the average grain size in the longitudinal wire direction was calculated.

As is apparent from Table 2, the average grain sizes in the longitudinal direction of samples A, B and C which had a relatively fast cooling rate during hot working, are within the range of 5 to 40 μm, and the area ratio of the precipitates at the grain boundaries is at most 2.0%. The grain sizes of samples D and E which had a slow cooling rate during hot working, were far greater than 40 μm, and the area ratio of precipitates at the grain boundaries exceeds 2.0%.

Referring to Table 2, a billet having a square cross-section of about 120×120 $mm^2$ was passed through a plurality of shaping rollers and rolled into a rod having a circular cross-section of about 12 mm in diameter.

Thereafter, all the samples A to E shown in Table 2 were subjected to first cold working, first heat treatment, scraping, second heat treatment and second cold working. The first cold working namely drawing with a degree of processing of about 30% was performed by using a plurality of dies. The first heat treatment was performed for 10 hours at 650° C. in a non-oxidizing atmosphere such as in a decomposed ammonia gas containing 75% by volume of $H_2$ and 25% by volume of $N_2$. The samples softened by the first heat treatment were peeled by scraping tools, and then subjected to second heat treatment under the same condition as the first heat treatment. The samples softened by the second heat treatment were drawn to have a diameter of about 2 to 5 mm with the degree of processing of about 85%, by passing through a plurality of dies. Thereafter the samples were dipped in a Zn-5 wt % Al alloy melt. The average grain size in the transverse direction, area ratio of precipitates at the grain boundaries and various mechanical properties of the wires having final wire size obtained through these steps are as shown in Table 3.

TABLE 3

| Sample | Area Ratio of Precipitates at Grain Boundaries (%) | Grain size in Transverse Direction (μm) | Turns of Twisting (turns/100d) 100 wires Average | σ | Tensile Strength (kg/mm²) | Elongation (%) |
|---|---|---|---|---|---|---|
| Present Invention | | | | | | |
| 1A | 0.5 | 2.9 | 125 | 5 | 128 | 2.5 |
| 1B | 1.6 | 1.9 | 115 | 8 | 128 | 2.3 |
| 1C | 3.5 | 1.2 | 95 | 20 | 126 | 2.0 |
| Comparative Example | | | | | | |
| 1D | 5.1 | 5.7 | 67 | 28 | 127 | 1.6 |
| 1E | 4.3 | 5.1 | 88 | 25 | 126 | 1.8 |
| Target Property | | | ≧16 turns/100d | | ≧120 | ≧1.5 |

Referring to Table 3, samples 1A to 1E are the samples obtained from samples A to E of Table 2. The samples 1A to 1E all have similar tensile strength exceeding the target property of 120 kg/mm². However, comparative examples 1D and 1E are inferior in twisting property and elongation as compared with samples 1A, 1B and 1C in accordance with the present invention.

The twisting property is represented by the number of possible twists applied to a single wire that is 100 times longer than the wire diameter d at about 60 rpm until the wire breaks. The value σ as used herein represents a standard deviation of the turns or twists of one hundred wires. The smaller the value σ, the higher the reliability, since a small value σ signifies that the twisting property is stable.

Referring to Table 3, the samples 1A and 1B have an area ratio of precipitates at the grain boundaries of at most 2.0% and the average grain size in the transverse direction is within the range of 1.5 to 4 μm. These samples 1A and 1B have a superior twisting property exceeding 100 turns. Additionally, the wires of samples 1A and 1B have a high twisting reliability as represented by the standard deviation σ of at most 10. The sample 1C has an area ratio of precipitates at the grain boundaries, exceeding 2% but not higher than 4% and the grain size of sample 1C in the cross sectional direction is within the range of 1 to 5 μm but not higher than 1.5 μm. As a result, sample 1C has a slightly inferior twisting property as compared with samples 1A and 1B. However, sample 1C can still satisfy the target property in 3σ management. More specifically, for the sample 1C, 95−3σ=35 turns apply, and hence sample 1C satisfies the required property (≧16 turns/100 d). On the other hand, comparative examples 1D and 1E having an area ratio of precipitates at the grain boundaries exceeds 4% and the grain size in the transverse direction exceeds 5 μm, the twisting property cannot satisfy the target property, in accordance with 3σ management. Further, in comparative examples 1D and 1E, though the target elongation property (≧1.5%) is satisfied, the elongation property is inferior to samples 1A to 1C in accordance with the present invention. Especially, in comparative example 1D, breakage was observed during cold working.

As already mentioned, samples 1A to 1E are obtained by performing the same cold working and heat treatment on the hot worked samples A to E of Table 2. It is to be understood that for obtaining a preferred twisting property, it is preferable that the area ratio of the precipitates at the grain boundaries in the rod after hot working is at most 2% and the grain size in the longitudinal direction is within the range of 5 to 40 μm.

TABLE 4

| Sample | Degree of Processing in 1st Cold Working (%) | 1st Heat Treatment (° C.) | Area Ratio of Precipitates at Grain Boundaries (%) | Turns of Twisting (turns/100d) 100 wires Average | σ | Tensile Strength (kg/mm²) | Elongation (%) |
|---|---|---|---|---|---|---|---|
| Present Invention | | | | | | | |
| 1A | 30 | 650 | 0.5 | 125 | 5 | 128 | 2.5 |
| 2A | 50 | 620 | 0.7 | 124 | 6 | 128 | 2.3 |
| 3A | 70 | 650 | 1.7 | 113 | 9 | 127 | 2.2 |
| 4A | 80 | 650 | 2.6 | 98 | 22 | 129 | 1.7 |
| 5A | 50 | 570 | 0.3 | 87 | 23 | 131 | 1.5 |
| 6A | 70 | 700 | 3.8 | 82 | 22 | 123 | 1.8 |
| Comparative Example 7A | 70 | 750 | 4.5 | 89 | 35 | 121 | 1.5 |

Table 4 shows the influence of the degree of processing by the first cold working and by the temperature of the immediately following first heat treatment on the area ratio of the precipitates at the grain boundaries and on various mechanical properties of the finished wires that have a finished wire size. Referring to Table 4, first cold working with various degrees of processing and first heat treatment at various temperatures were performed on sample A of Table 2. The processes performed after the first heat treatment are the same as those described with reference to Table 3. Samples 1A to 7A all have similar tensile strength higher than the target strength of 120 kg/mm$^2$.

Samples 1A to 6A represent the present invention since they have an area ratio of the precipitates at the grain boundaries in the finished state of at most 4%. These samples satisfy the target value of the twisting property (≧16 turns/100 d) even under 3σ management. However, the comparative example 7A has an area ratio of the precipitates at the grain boundaries in the finished state that exceeds 4%. Hence, example 7A cannot satisfy the target value for the twisting property under 3σ management (89−3σ=89−3×35<16 turns).

Now, sample 4A is processed with the degree of processing of the first cold working being 80%, exceeding 70%, and hence the area ratio of the precipitates at the grain boundaries of the finished state exceeds 2%, but is not higher than 4%. Therefore, it is inferior to samples 1A to 3A in twisting property and elongation.

In other words, the degree of processing of the first cold working should more preferably be at most 70%.

Further, for the sample 5A, the temperature of the first heat treatment was 570° C., which was not higher than 600° C. Therefore, the amount of precipitates at the grain boundary was small. However, since the strain in the wire is not sufficiently removed, the turns of twisting vary as compared with samples 1A to 3A. As a result, the average of twisting turns is low and the elongation quality is degraded. Namely, the temperature for the first heat treatment should more preferably be at least 600° C.

Further, for the sample 6A, a relatively large degree of processing of 70% was set for the first cold working, and a relatively high temperature of 700° C. was set for the heat treatment. Therefore, the area ratio of the precipitates at the grain boundaries in the finished state was larger as compared with samples 1A to 1C and, as a result, the twisting and elongation properties were degraded. Especially when the temperature for the first heat treatment exceeds 700° C., the area ratio of the precipitates at the grain boundaries in the finished state exceeds 4% as in comparative example 7A, and hence the target twisting property (≧16 turns/100 d) cannot be satisfied. In other words, the temperature for the first heat treatment should preferably be in the range of 600° C. to 700° C.

TABLE 5

| Sample | Degree of Processing in 1st Cold Working (%) | 1st & 2nd Heat Treatment (° C.) | Degree of Processing in 2nd Cold Working (%) | Average Grain size in Transverse Direction (μm) | Turns of Twisting (turns/100d) 100 wires Average | σ |
|---|---|---|---|---|---|---|
| Present Invention | | | | | | |
| 11(B) | 30 | 700 | 92 | 2.8 | 113 | 7 |
| 12(A) | 70 | 650 | 94 | 3.1 | 120 | 8 |
| 13(B) | 50 | 670 | 96 | 1.7 | 97 | 13 |
| 14(A) | 80 | 700 | 86 | 4.5 | 91 | 24 |
| 15(C) | 50 | 620 | 92 | 0.9 | 87 | 35 |

TABLE 5-continued

| Sample | Degree of Processing in 1st Cold Working (%) | 1st & 2nd Heat Treatment (° C.) | Degree of Processing in 2nd Cold Working (%) | Average Grain size in Transverse Direction (μm) | Turns of Twisting (turns/100d) 100 wires Average | σ |
|---|---|---|---|---|---|---|
| 16(E) | 70 | 700 | 87 | 5.6 | 89 | 36 |
| Comparative Example 17(D) | 70 | 650 | 81 | 7.2 | 35 | 22 |
| | | Target value | | | ≧16 turns/100d | |

Table 5 shows the influence of hot working, cold working and heat treatment on the average grain size in the transverse direction of the wire and the twisting property of the wire having a finished wire size. The letters (A) to (E) appended to the sample numbers of Table 5 represent that the samples are obtained by performing first cold working, first heat treatment, scraping, second cold working and Zn-5 wt % Al alloy plating on the hot worked samples A to E of Table 2. For each sample of Table 5, the temperature for the first and second heat treatments before and after scraping is set to be the same temperature.

As can be seen from Table 5, samples 11 to 14 of the present invention have an average grain size in the transverse direction of the finished wire within the range of 1 to 5 μm and satisfy the target value for the twisting property (≧16 turns/100 d) even at the 3σ management. By contrast, comparative examples 15 to 17 have a grain size in the transverse direction out of the range of 1 to 5 μm cannot satisfy the target value for the twisting property at 3σ management.

Now, for sample 14, the degree of processing in the first cold working was 80%, which is higher than 70%, so that the grain size in the transverse direction at the final state exceeds 4%, though not higher than 5%, and the twisting property is inferior to samples 11 to 13.

Therefore, the degree of processing of the first cold working should desirably be at most 70%.

The small grain size in the transverse direction of the wire of comparative example 15 may be related to a small grain size in the longitudinal direction of sample C in Table 2. As compared with samples A and B, sample C has a relatively large area ratio of the precipitates at the grain boundaries, and the area ratio of the precipitates at the grain boundary of the finished wire of sample 15 was increased to 4.4%, even though the temperatures for the first and second heat treatments were relatively low.

Further, in comparative example 17 having very large grain size in the transverse direction, breakage was observed during the second cold working.

Then, alloys such as shown in Table 6 were melted and cast in order to see the influence of impurities on the INVAR® or iron nickel alloy wire. Referring to Table 6, numerical values related to respective elements denote percentage by weight in the alloy.

TABLE 6

| Sample | | C | Mn | Ni | Co | Cr | Mo | P | S | O | N | Fe |
|---|---|---|---|---|---|---|---|---|---|---|---|---|
| Present | 21 | 0.25 | 0.30 | 35.0 | 3.01 | 0.98 | 2.01 | 0.002 | 0.001 | 0.0015 | 0.0013 | Remaining part |
| Invention | 22 | 0.27 | 0.27 | 35.0 | 3.00 | 1.01 | 1.96 | 0.004 | 0.002 | 0.003 | 0.006 | Remaining part |
| | 23 | 0.24 | 0.26 | 35.2 | 3.01 | 0.99 | 1.98 | 0.009 | 0.004 | 0.005 | 0.008 | Remaining part |
| Comparative | 24 | 0.27 | 0.26 | 35.1 | 2.98 | 1.02 | 1.85 | 0.014 | 0.002 | 0.006 | 0.007 | Remaining part |
| Example | 25 | 0.24 | 0.27 | 35.0 | 2.99 | 1.01 | 2.02 | 0.009 | 0.007 | 0.004 | 0.006 | Remaining part |
| | 26 | 0.25 | 0.28 | 35.1 | 2.97 | 0.99 | 1.98 | 0.012 | 0.004 | 0.004 | 0.009 | Remaining part |
| | 27 | 0.28 | 0.27 | 35.2 | 3.00 | 1.02 | 2.01 | 0.009 | 0.007 | 0.006 | 0.009 | Remaining part |

TABLE 7

| Sample | Twisting Property (turns/100d) 100 wires average | σ | Tensile Strength (kg/mm$^2$) | Elongation (%) |
|---|---|---|---|---|
| Present Invention | | | | |
| 21 | 125 | 5 | 127 | 2.5 |
| 22 | 122 | 6 | 127 | 2.5 |
| 23 | 115 | 11 | 127 | 2.3 |
| Comparative Example | | | | |
| 24 | 75 | 20 | 127 | 2.0 |
| 25 | 96 | 27 | 126 | 2.1 |
| 26 | 74 | 22 | 126 | 1.9 |
| 27 | 48 | 25 | 125 | 1.7 |
| Target Property >16 (turns/100d) | | | ≧120 | ≧1.5 |

Table 7 shows various mechanical properties of the finished wire of the INVAR® or iron nickel alloy having composition as shown in Table 6.

Of each of the samples having compositions as shown in Table 6, a billet was heated to 1200° C., and thereafter cooled to about 600° C. at the cooling rate of 10° C./sec, while the billet is rolled by shading rollers. The obtained rolled rods were examined and it was found that every rod had an area ratio of the precipitates at the grain boundaries of about 0.2% and an average grain size of about 22 μm in the longitudinal direction.

The rolled rods which were hot worked were all subjected to a first cold drawing of 22%, scraping, heat treatment at 650° C. for 10 hours, a second cold drawing of 86% and plating with Zn-5 wt % Al alloy.

Referring to Table 7, samples 21 to 27 all have similar tensile strength exceeding the target value of 120 kg/mm$^2$. However, it is apparent that comparative examples 24 to 27 have an inferior twisting property and elongation as compared with the samples 21 to 23 of the present invention.

More specifically, samples 21 to 23 of the present invention containing P of at most 0.01 percent by weight, S of at most 0.004 percent by weight, O of at most 0.005 percent by weight and N of at most 0.008 percent by weight have a superior twisting property. Especially, samples 21 and 22 which include P of at most 0.005 percent by weight, S of at most 0.002 percent by weight, O of at most 0.003 percent by weight and N of at most 0.006 percent by weight only as impurities, have a superior twisting property and stability which means that σ is small.

Comparative examples 24 to 27 all include at least one impurity of P exceeding 0.001 percent by weight, S exceeding 0.004 percent by weight, O exceeding 0.005 percent by weight, N exceeding 0.008 percent by weight, so that these examples have a far inferior twisting property compared to the samples 21 to 23 of the present invention, and the target value (≧16 turns/100 d) for the twisting property cannot be achieved.

In any of the above described embodiments, various properties of the wire are hardly influenced when Mo of the alloy element is replaced by V, and hence V can be similarly used as Mo.

As described above, according to the present invention, toughness, especially the twisting property of an INVAR® or iron nickel alloy wire having high strength can be improved, and by using the same, the production yield of overhead conductor cables can be improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A finished electrical conductor wire having a given cross-sectional area and a longitudinal axis extending perpendicularly to said cross-sectional area, said finished wire comprising an iron alloy including a nickel content (Ni) within the range of 34 to 40.0 wt. % and carbon within the range of 0.1 to 0.5 wt. % as alloying elements, and impurities including as weight % of the alloy: phosphorous (P) 0.01 wt. % at most, sulfur (S) 0.004 wt. % at most, oxygen (O) 0.005 wt. % at most, and nitrogen (N) 0.008 wt. % at most, said alloy in said finished wire having grains with an average grain size within the range of 1 to 5 μm as ascertained from a micrograph taken of said given cross-sectional area, said finished wire further comprising precipitates at boundaries between said grains in said alloy, said precipitates taking up a surface area ratio of 4% at most of said given cross-sectional area, whereby said finished wire has an improved strength and toughness including an improved twisting ability, and a low thermal expansion as determined by said nickel content.

2. The finished wire of claim 1, wherein said surface area ratio of said precipitates is 2% at most.

3. The finished wire of claim 1, wherein said average grain size is within the range of 1.5 to 4 μm.

4. The finished wire of claim 1, wherein said iron alloy further comprises cobalt (Co) as an alloying element within the range of more than 0 wt. % to 6 wt. %.

5. The finished wire of claim 4, wherein the total nickel and cobalt content is not more than 40 wt %.

6. The finished wire of claim 1, wherein said iron alloy further comprises at least one element selected from the group consisting of Mo, Cr, W, Nb, Ti, V, and Si for an increased material strength.

7. The finished wire of claim 6, wherein said molybdenum is within the range of 1.0 to 4.0 wt. %.

8. The finished wire of claim 6, wherein said chromium content is within the range of more than 0 wt. %, but not more than 1.1 wt. %.

9. The finished wire of claim 6, wherein said iron alloy further comprises at least one deoxidizer selected from the group consisting of Mn, Al, Mg, Ti, and Ca for deoxidizing said alloy.

10. The finished wire of claim 1, wherein said impurities include as the weight % of the iron alloy: phosphorus (P) 0.005 wt. % at most, sulfur (S) 0.002 wt. % at most, oxygen (O) 0.003 wt. % at most, and nitrogen (N) 0.006 wt. % at most.

* * * * *